US007410095B2

(12) United States Patent
Selover

(10) Patent No.: US 7,410,095 B2
(45) Date of Patent: Aug. 12, 2008

(54) COIN VAULT FOR COMMERCIAL APPLIANCES

(75) Inventor: Michael D. Selover, Baxter, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 344 days.

(21) Appl. No.: 11/172,258

(22) Filed: Jun. 30, 2005

(65) Prior Publication Data

US 2007/0000988 A1 Jan. 4, 2007

(51) Int. Cl.
*G07B 15/00* (2006.01)

(52) U.S. Cl. ..... 232/16; 194/350; 70/85

(58) Field of Classification Search ..... 232/15, 232/16, 1 D; 194/350, 202; 312/333; 70/85
See application file for complete search history.

(56) References Cited

U.S. PATENT DOCUMENTS 3,083,896 A * 4/1963 Cairelli et al. ..... 232/15
3,175,759 A * 3/1965 Teale et al. ..... 232/1 R
3,297,123 A 1/1967 Hutchins
3,335,945 A 8/1967 Hutchins
3,339,835 A 9/1967 Itman
3,455,425 A 7/1969 Douglas
3,538,724 A * 11/1970 Dauenbaugh ..... 70/86
3,645,598 A 2/1972 Greenwald
3,844,144 A 10/1974 Schmitt
3,926,366 A * 12/1975 Sciortino ..... 232/15
4,133,419 A * 1/1979 Greenwald et al. ..... 194/350
4,177,889 A * 12/1979 Adams et al. ..... 194/350
4,881,632 A 11/1989 LiCausi
5,224,579 A 7/1993 Brown
5,291,981 A 3/1994 Anello et al.
5,507,378 A * 4/1996 Leone ..... 194/202
5,873,446 A * 2/1999 Wei ..... 194/350

* cited by examiner

*Primary Examiner*—William L. Miller
(74) *Attorney, Agent, or Firm*—Clifton Green; Michael D. Lafrenz

(57) ABSTRACT

An improved coin box assembly is provided for a coin operated laundry appliance. The assembly includes a mounting bracket mounted in the cabinet of the appliance, a vault mounted within the mounting bracket, and a coin box mounted within the vault. The mounting bracket and vault provide double-wall protection for the coin box so as to inhibit prying. The assembly further includes external and internal plates sandwiching the front wall of the coin box to prevent cutting of the front wall of the coin box. A freely-spinning washer is mounted between the front plate and the front wall of the coin box to preclude a hole saw from cutting out the lock cylinder of the coin box.

30 Claims, 6 Drawing Sheets

COIN VAULT FOR COMMERCIAL APPLIANCES

BACKGROUND OF THE INVENTION

Commercial laundry appliances used in commercial laundry facilities, university and college student housing, and other public settings, are typically coin operated, and accordingly, include a coin box for storing the coins deposited by users to operate the washer and dryer machines. It is not unusual for the coin boxes to hold several hundred dollars of quarters, which, unfortunately, creates theft problems. For example, it has been known for thieves to use drilling, prying, torching, and cutting tools to gain access to the coin box so as to steal the money therein.

Prior art coin operated appliances have been designed with coin boxes mounted in a small protective vault so as to make theft more complicated. However, theft remains a problem, particularly as battery operated tools make it easier for a thief to breach weak points in the security of the coin box and/or vault.

For example, existing designs for the coin box of commercial appliances are susceptible to hole saw attack around the shoulder of the lock, and due to the material specifications of the coin box, which are not designed to stop cutting with a hole saw. Similarly, existing designs are susceptible to prying attack due to a single wall vault and a coin box design which does not withstand prying pressure. A relatively small opening allows a thief to vacuum out the coins with a small vacuum, or to string out the coins with adhesive-type materials to which the coins stick.

Accordingly, a primary objective of the present invention is the provision of an improved coin box assembly for commercial laundry appliances.

Another objective of the present invention is the provision of a high security coin vault with redundant security features to defeat common break-in methods for commercial laundry appliances.

Another objective of the present invention is a coin vault designed for commercial laundry appliances which guards against drilling, prying, torching, and cutting attacks.

A further objective of the present invention is the provision of an improved coin vault assembly for commercial laundry appliances which defeats common break-in methods using common burglary tools.

Still another objective of the present invention is the provision of a comprehensive redundant money handling, high security system for coin operated machines.

Another objective of the present invention is the provision of a coin operated appliance or machine having a coin box, coin vault, and mounting bracket which compliment one another so as to withstand break-in attempts.

A further objective of the present invention is the provision of an improved coin operated appliance or machine having high levels of security with low impact to production cost.

Still another objective of the present invention is an improved coin operated laundry appliance having no visible points of attack to the coin box.

Yet another objective of the present invention is the provision of an improved security coin vault for coin operated machine wherein the coin box assembly includes a double-wall, pry-resistant design.

Yet another objective of the present invention is the provision of an improved security coin box assembly for a commercial laundry appliance having a front plate assembly on the coin box which is resistant to drilling and cutting.

Another objective of the present invention is the provision of an improved security coin vault for commercial laundry appliances wherein welds in the assembly are hidden, masked or finished.

These and other objectives will become apparent from the following description of the invention.

BRIEF SUMMARY OF THE INVENTION

An improved coin box assembly is provided for a commercial laundry appliance. The assembly includes a mounting bracket mounted to the appliance, a vault mounted within the mounting bracket, and a coin box mounted within the vault. The mounting bracket and vault form a triple wall with hemmed edge of bracket over the coin box so as to inhibit prying against the coin box. The assembly further includes a front security plate assembly with an external security plate mounted over the front wall of the coin box and an internal lock plate mounted behind the front wall of the coin box, with the external and internal plates being bolted together. A freely spinning washer is sandwiched between the external plate and the front wall of the coin box so as to surround the lock cylinder in the coin box, to prevent drilling out of the lock cylinder from the coin box. Welds on the vault are partially covered by the mounting bracket, and otherwise finished so as to be imperceptible. Welds on the external security plate are also finished so as to be imperceptible.

DETAILED DESCRIPTION OF THE PREFERRED EMBODIMENT

Figure 1:
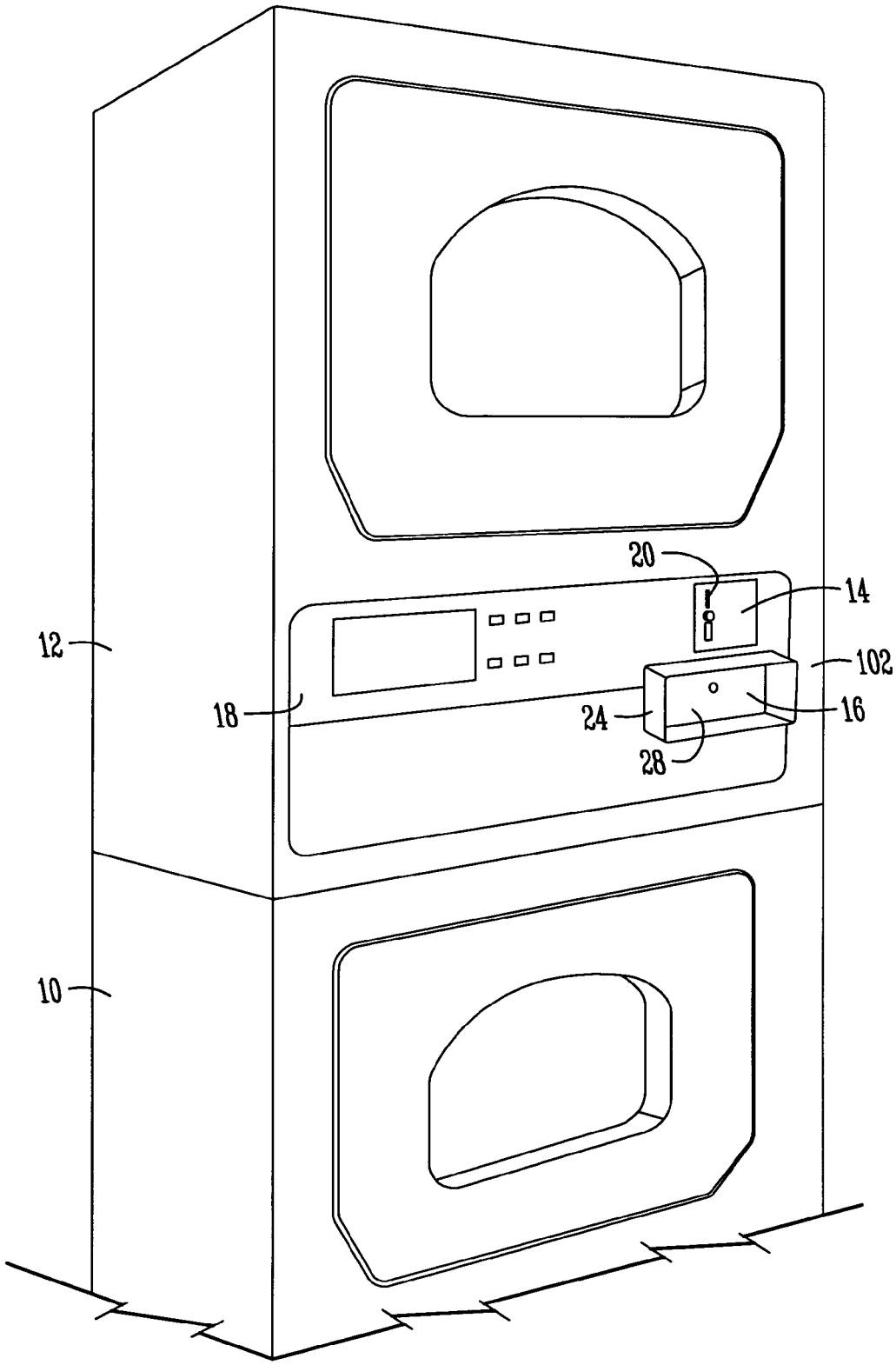
FIG. 1 is a perspective view of a commercial washer and dryer appliance in a stacked unit.

FIG. 1 shows a commercial laundry appliance with a washer 10 and dryer 12 arranged in a stacked unit. The washer 10 and dryer 12 are coin operated, and include a coin deposit 14, and the improved coin box assembly 16 of the present invention. A control panel 18 provides user control of the washer 10 and dryer 12 when coins, normally quarters, are deposited in the coin slot 20.

It is understood that the coin box assembly 16 can be used on stand alone washers and dryers, stacked washers and dryers, as well as other coin operated machines, such as vending machines.

Figure 2:
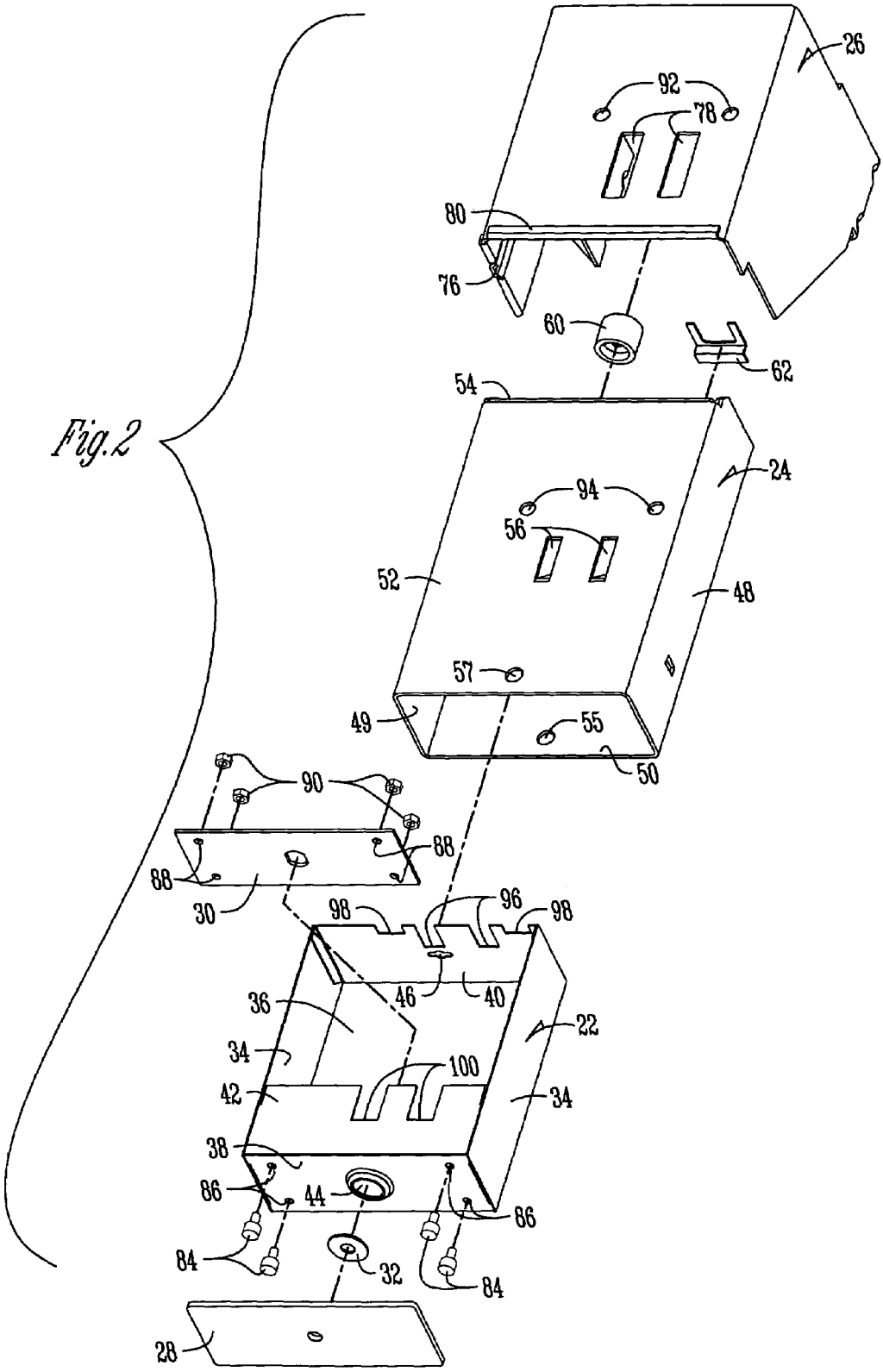
FIG. 2 is an exploded perspective view of the improved coin box assembly of the present invention.
Figure 3:
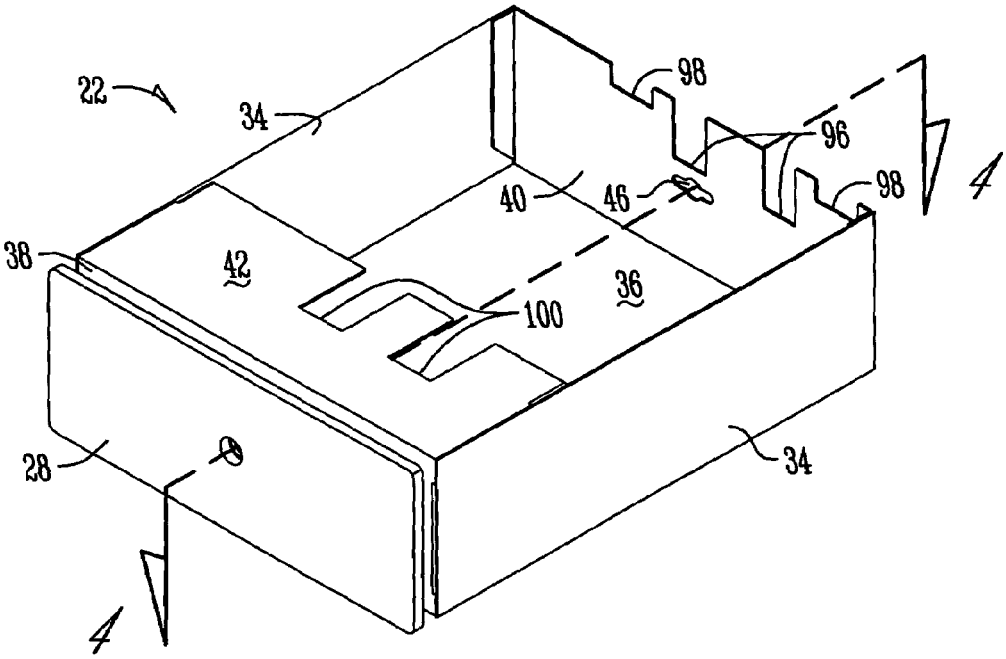
FIG. 3 is a perspective view of the coin box with the front security plate assembly of the present invention.

The components of the coin box assembly 16 are best shown in FIG. 2. The primary components are a coin box 22, a vault 24, and a mounting bracket 26. The assembly further includes an external security plate 28, an internal lock plate 30, and a free-spinning washer 32.

The coin box 22 includes opposite side walls 34, a bottom wall 36, a front wall 38, a rear wall 40, and a partial top wall 42. The front wall 38 includes a central opening 44 to receive a lock cylinder (not shown). The rear wall 40 includes a key hole opening 46.

Figure 5:
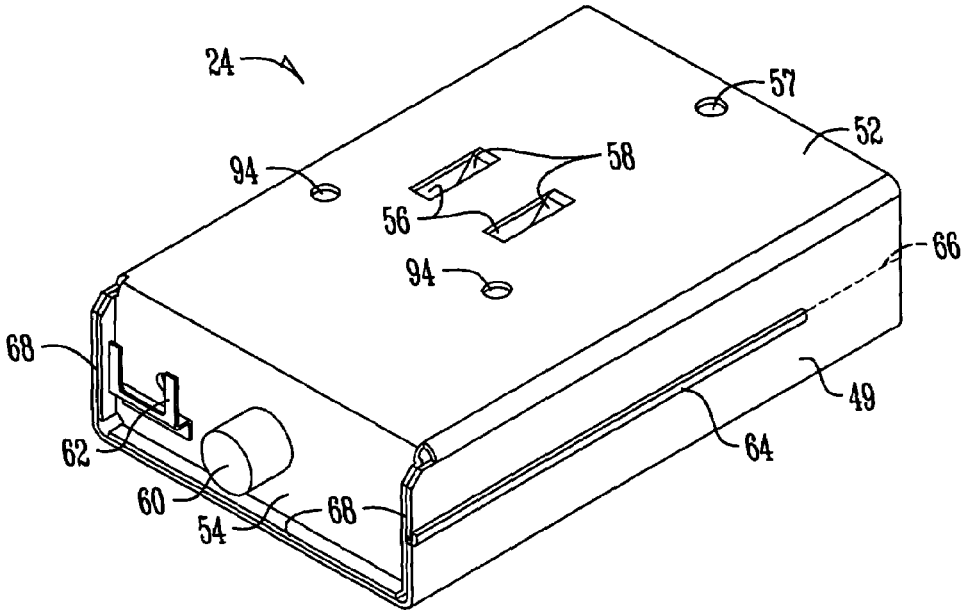
FIG. 5 is a rear, top perspective view of the coin vault of the present invention.
Figure 6:
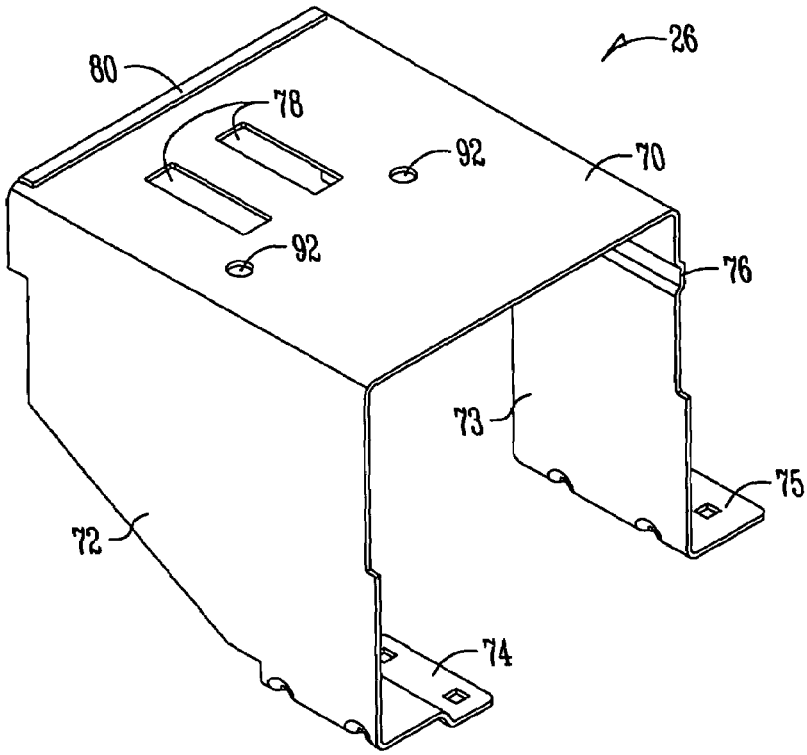
FIG. 6 is a rear, top perspective view of the mounting bracket of the present invention.

The coin vault 24 includes opposite side walls 48, 49, a bottom wall 50, a top wall 52, and a rear wall 54. The front of the vault 24 is open so as to receive the coin box 22. As best seen in FIG. 5, the top wall 52 of the vault 24 includes a pair of lanced openings 56, with tabs 58 extending downwardly into the interior of the vault 24. The rear wall 54 of the vault 24 includes a lock bracket 60 and a switch bracket 62, both of which are welded to the rear wall 54. The lock bracket 60 is centered over the key hole opening 46 of the coin box 22 when the coin box is installed in the vault 24. The walls of the vault 24 are preferably made from a single piece of folded and welded hardened steel. The side wall 49 of the vault 24 includes an overlapped edge 64 extending approximately three-fourths the length of the vault 24 from the rearward end towards the front opening. The overlapped edge 64 is spot welded periodically along its length. The forward portion of the side wall 49 includes abutting edges forming a joint 66 extending approximately one-quarter the length of the side wall 49, from the front opening towards the rear. The joint 66 is fully welded and then finish ground on both the interior and exterior such that weld is completely hidden from view. The rear wall 54 of the vault 24 is folded from the top wall 52, and includes folded or bent flanges 68 on the opposite sides and the bottom edge which are spot welded to the side walls 48, 49 and to the bottom wall 50 of the vault. The vault 24 includes aligned holes 55, 57 in the bottom and top walls 50, 52 respectively. The holes 55, 57 are adapted to receive the yoke of a padlock, lock bar or device so as to provide further security for the coin box 22.

The mounting bracket 26 is preferably formed from a single piece of hardened steel. The mounting bracket 26 includes a top wall 70, and opposite side walls or legs 72, 73 which terminate in turned feet 74, 75. The leg 73 of the bracket 26 has a groove or recess 76 formed therein so as to receive the overlapped edge 64 of the vault 24. The top wall 70 of the bracket 26 includes a pair of elongated holes 78 which are aligned with the lanced openings 56 in the vault 24, when the vault is mounted in the bracket 26. The top wall 70 also includes a hemmed front edge 80. The front edge 82 of the leg 73 may also be hemmed on opposite sides of the groove 76.

Figure 4:
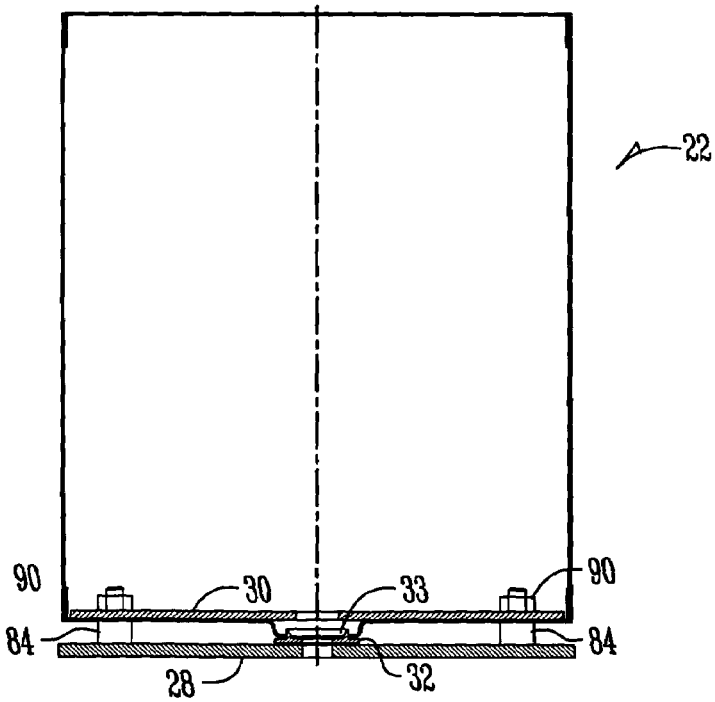
FIG. 4 is a sectional view taken along lines 4-4 of FIG. 3 and showing the security plate assembly.

The external plate 28 and internal plate 30 are mounted on opposite sides of the front wall 38 of the coin box 22 so as to provide additional security for the coin box 22. A plurality of bolts 84 are welded to the inside of the external plate 28 as seen in FIGS. 2 and 4. The bolts extend through holes 86 in the front wall 38 of the coin box 22 and through aligned holes 88 in the internal plate 30. Nuts 90 are received on the end of the bolts 84 so that the plates 28, 30 are secured to opposite sides of the coin box front wall 38. The front side of the external plate 28 is finished so as to obscure or hide the welds for the bolts 84. The finishing operation may take the form of brushing, painting, grinding, plating, adding a fascia or other known manners for hiding the heat affected zone of the welding operation.

Figure 7:
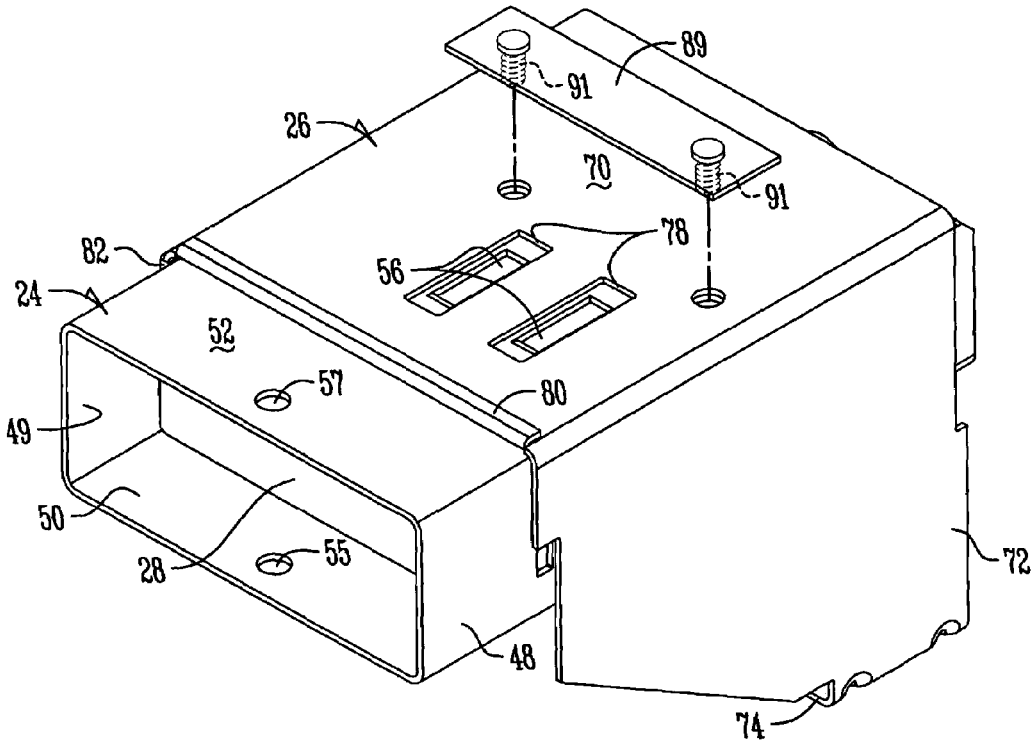
FIG. 7 is a front, top perspective view of the coin vault mounted in the mounting bracket.
Figure 8:
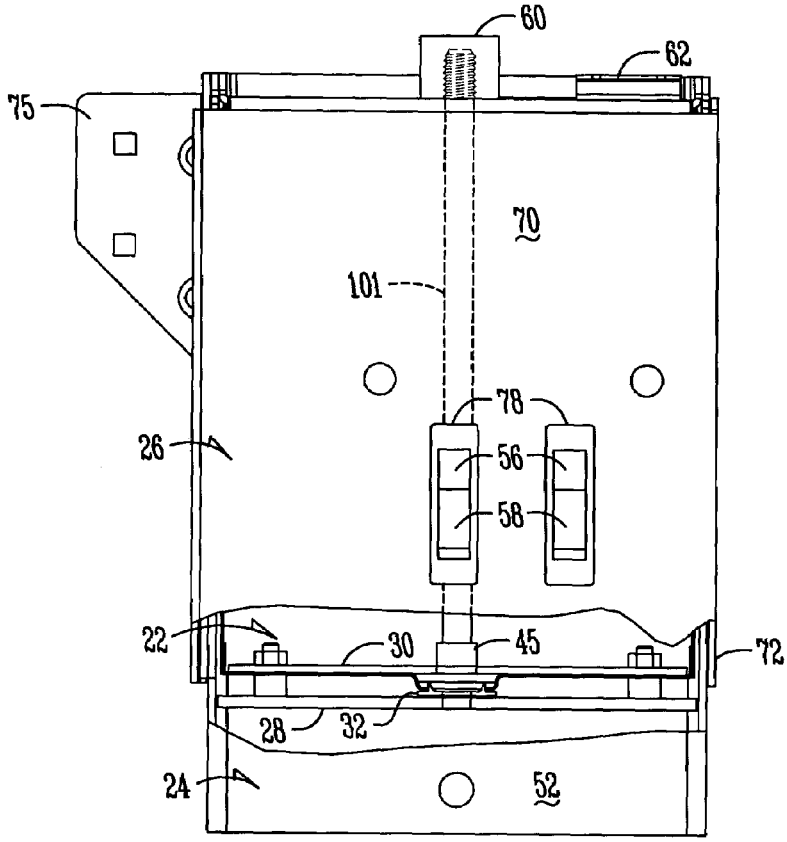
FIG. 8 is a top plan view of the improved coin box assembly of the present invention.
Figure 9:
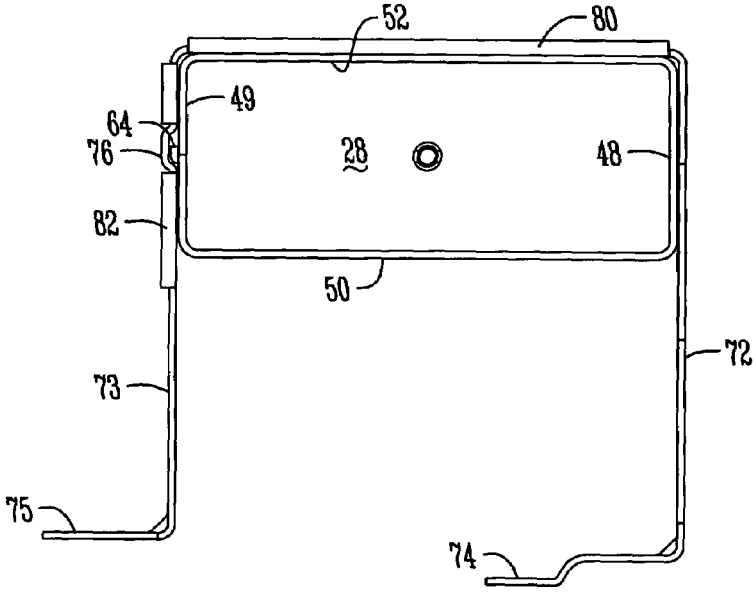
FIG. 9 is a front elevation view of the assembly.

The assembled coin box assembly 16 is best seen in FIGS. 7-9. The first step of the assembly process is to mount the security plates 28, 30 to the coin box 22, with the freely-rotating washer 32 mounted over the lock cylinder opening 44 of the coin box 22. Washer 32 includes a cylindrical extension 33 which resides within opening 44. The vault 24 is mounted to the bracket 26 using projection-welded studs 91 on a mounting strap 89 extending through aligned holes 92 in the bracket 26 and holes 94 in the vault 24 and nuts (not shown) secured onto the studs 91 inside the vault 24. The projection welded studs 91 on the mounting strap 89 prevents another point of attack that would be present if the studs 91 included a hex head.

The coin box 22 can then be inserted into the open front end of the vault 24. The back wall 40 of the coin box 22 includes notches or recesses 96 which allow the inwardly-extending tabs 58 on the vault 24 to pass therethrough. The back wall 40 of the coin box 22 also includes recesses 98 which allow the nuts on the studs 91 to pass therethrough. The top wall 42 of the coin box 22 includes notches 100 within which the tabs 58 reside when the coin box 22 is fully inserted into the vault 24. The key hole opening 46 in the rear wall 40 of the coin box 22 allows the coin box to be secured to the rear wall 54 of the vault 24 using a quarter-turn locking pin (not shown). Alternatively, an elongated rod 101 can extend from the lock cylinder 45 and into the threaded lock bracket 60 to secure the coin box 22 within the vault 24. When fully inserted, the front wall 38 of the coin box 22 is recessed within the vault 24 and substantially aligned with the hemmed front edge 80 of the mounting bracket 26, thereby forming a triple wall layer over the front wall 38 of the coin box 22, so as to inhibit prying against the coin box 22.

The coin box assembly 16 is then mounted within the cabinet 102 of the dryer 12 or washer 10. When the mounting is complete, the holes 78 in the bracket 26 and the openings 56 of the vault 24 are aligned beneath the coin deposit 14, such that coins drop from the coin deposit 14, through the holes 78 and 56, and into the coin box 22. A front portion of the vault 24 extends outwardly from the cabinet 102, as seen in FIG. 1, and provides a hood or shield around the external plate 28. The extended hood of the vault 24 minimizes the amount of leverage a potential thief can apply with a pry bar. Furthermore, the tops and sides of the vault 24 and mounting bracket 26 provide a triple wall construction around the coin box 22 approximately aligned with front wall 38, so as to provide further security to the coin box 22. The external front plate 28 inhibits drilling, cutting or torching. Even if a potential thief uses a hole saw to cut through the front plate 28 in an effort to remove the lock cylinder 45 of the coin box 22, the freely-rotating washer 32 rotates with the hole saw to preclude further cutting into front wall 38 of the coin box 22. The masked or hidden welds for the bolts 84 and for the side wall 49 of the vault 24 provide no clue to a potential thief of any break points or weak points in the assembly 16.

Also, as best seen in FIG. 4, the bolts 84 provide an air space between the front security plate 28 and front wall 38 of the coin box 22. Thus, a thief using a cutting torch is forced to cut through the plate 28 and the coin box front wall 38/internal plate 30 in two separate torching operations, which takes longer so as to deter or discourage theft.

The owner, manager, and/or other authorized personnel may open the coin box 22 using a key to release an elongated bolt 101 extending from the lock cylinder 45 to the lock bracket 60.

The mounting bracket 26 is normally used in a stacked washer and dryer. However, the mounting bracket 26 may be eliminated in a stand alone washer or dryer, with the vault 24 being attached or mounted to the top cover, base, or other component using the mounting strap 89.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An improved coin box assembly for a coin-activated appliance having a cabinet and a coin deposit device, the assembly comprising:

a mounting bracket mounted to the appliance, the mounting bracket having a top wall with a hemmed front edge;

a vault mounted within the mounting bracket, and having a top wall placed adjacent to the top wall of the mounting bracket;

a coin box mounted within the vault such that a front wall of the coin box is approximately aligned with the hemmed front edge of the mounting bracket, whereby the hemmed front edge of the mounting bracket top wall and the vault top wall form a triple wall layer over the coin box front wall so as to inhibit prying against the coin box.

2. The improved coin box assembly of claim 1 wherein the vault surrounds the coin box on five sides.

3. The improved coin box assembly of claim 1 wherein the vault includes a front hood projecting forwardly from the coin box.

4. The improved coin box assembly of claim 1 wherein the vault has no visible seams outside the appliance cabinet.

5. The improved coin box assembly of claim 1 wherein the mounting bracket surrounds the vault on three sides.

6. The improved coin box assembly of claim 1 wherein the mounting bracket is mounted within the cabinet so as to be hidden from view.

7. The improved coin box assembly of claim 1 wherein the vault has a welded seam and the mounting bracket has a channel to receive the welded seam.

8. The improved coin box assembly of claim 1 wherein the mounting bracket and vault have aligned holes over the coin box through which coins from the coin deposit device pass into the coin box.

9. The improved coin box assembly of claim 8 wherein the hole in the vault is lanced to define a tab which inhibits vacuuming and stringing of coins from the coin box.

10. The improved coin box assembly of claim 1 wherein the coin box front wall includes a lock cylinder mounted therein.

11. The improved coin box assembly of claim 10 further comprising an external security plate mounted over the front wall of the coin box and an internal lock plate mounted behind the coin box front wall, the external and internal plates being secured together.

12. The improved coin box assembly of claim 11 further comprising a washer sandwiched between the external plate and the front wall of the coin box so as to surround the lock cylinder and so as to spin freely about the lock cylinder so as to prevent cutting out of the lock cylinder from the coin box.

13. The improved coin box assembly of claim 11 wherein the external plate has front and back sides, and further comprising a plurality of bolts welded to the back side of the external plate, the bolts extending through the front wall of the coin box and through the internal plate; and a plurality of nuts received on the bolts behind the internal plate.

14. The improved coin box assembly of claim 13 wherein the front side of the external plate is finished so as to mask the welds of the bolts.

15. The improved coin box assembly of claim 11 wherein the external security plate is spaced from the front wall of the coin box so as to define an air space therebetween to inhibit torching.

16. An improved coin box assembly for a coin activated machine having a cabinet and a coin deposit device, the assembly comprising:

a vault mounted to the machine;

a coin box with a front wall, the coin box being mounted within the vault;

an internal lock plate mounted behind the coin box front wall and having a lock cylinder mounted thereto;

an external security plate mounted over the coin box front wall; and the external and internal plates being secured together.

17. The improved coin box assembly of claim 16 further comprising a mounting bracket mounted to the machine and within which the vault is mounted.

18. The improved coin box assembly of claim 17 wherein the mounting bracket and vault each having top walls adjacent one another so as to form a multi-layer wall over the coin box so as to inhibit prying against the coin box.

19. The improved coin box assembly of claim 16 wherein the vault includes a front edge projecting forwardly from the coin box.

20. The improved coin box assembly of claim 16 wherein the vault has no visible seams outside the appliance cabinet.

21. The improved coin box assembly of claim 16 wherein the vault has a lanced hole through which coins from the coin deposit device pass into the coin box, with the lanced hole defining a tab which inhibits vacuuming and stringing of coins from the coin box.

22. The improved coin box assembly of claim 16 wherein a washer is sandwiched between the external plate and the front wall of the coin box so as to surround the lock cylinder and so as to spin freely about the lock cylinder so as to prevent cutting out of the lock cylinder from the coin box.

23. The improved coin box assembly of claim 16 wherein the external plate has front and back sides, and further comprising a plurality of bolts welded to the back side of the external plate, the bolts extending through the front wall of the coin box and through the internal plate, and nuts received on the bolts behind the internal plate.

24. The improved coin box assembly of claim 23 wherein the front side of the external plate is finished so as to mask the welds of the bolts.

25. The improved coin box assembly of claim 16 wherein the external security plate is spaced from the front wall of the coin box so as to define an air space therebetween to inhibit torching.

26. The improved coin box assembly of claim 16 wherein the vault includes upper and lower aligned holes adapted to receive a locking device.

27. An improved coin box assembly for a coin-activated machine having a cabinet and coin deposit device, the assembly comprising:

a vault mounted to the machine;

a coin box mounted within the vault and having a front wall;

an external security plate mounted over the front wall of the coin box and having a finished surface without visible weld marks;

an internal lock plate mounted behind the front wall of the coin box; and a mounting bracket mounted to the machine and within which the vault is mounted.

28. The improved coin box assembly of claim 27 wherein the internal and external plates are secured together.

29. The improved coin box assembly of claim 27 wherein the external plate has front and back sides, and further comprising a plurality of bolts welded to the back side of the external plate, the bolts extending through the front wall of the coin box and through the internal plate; and a plurality of nuts received on the bolts behind the internal plate.

30. The improved coin box assembly of claim 27 wherein the external security plate is spaced from the front wall of the coin box so as to define an air space therebetween to inhibit torching.

* * * * *